US011399671B2

(12) United States Patent
Cimadamore

(10) Patent No.: US 11,399,671 B2
(45) Date of Patent: Aug. 2, 2022

(54) SHOWER CABIN ASSEMBLY

(71) Applicant: HSIGN S.R.L., Monte Giberto (IT)

(72) Inventor: Anna Luisa Cimadamore, Fermo (IT)

(73) Assignee: HSIGN S.R.L., Monte Giberto (IT)

( * ) Notice: Subject to any disclaimer, the term of this patent is extended or adjusted under 35 U.S.C. 154(b) by 407 days.

(21) Appl. No.: 16/604,338

(22) PCT Filed: Apr. 12, 2017

(86) PCT No.: PCT/IB2017/052105
§ 371 (c)(1),
(2) Date: Oct. 10, 2019

(87) PCT Pub. No.: WO2018/189571
PCT Pub. Date: Oct. 18, 2018

(65) Prior Publication Data
US 2020/0154955 A1 May 21, 2020

(51) Int. Cl.
*A47K 7/04* (2006.01)
*A47K 3/28* (2006.01)
(Continued)

(52) U.S. Cl.
CPC ..... *A47K 7/04* (2013.01); *A47K 3/281* (2013.01); *A47K 7/024* (2013.01); *A61H 33/005* (2013.01);
(Continued)

(58) Field of Classification Search
CPC ..... A47K 7/004; A47K 7/022; A47K 7/024; A47K 3/281; A47K 7/04; A61H 33/005;
(Continued)

(56) References Cited

U.S. PATENT DOCUMENTS 4,228,557 A * 10/1980 De Vivo ..... A47K 7/04 15/88.4
4,807,602 A 2/1989 Scarborough
(Continued)

FOREIGN PATENT DOCUMENTS

WO WO-2011143885 A1 11/2011
WO WO-2018189571 A1 10/2018

OTHER PUBLICATIONS

International Search Report and Written Opinion dated Dec. 20, 2017, in International Application No. PCT/IB2017/052105, European Patent Office, Netherlands, 11 pages.

*Primary Examiner* — Huyen D Le
(74) *Attorney, Agent, or Firm* — Sterne, Kessler, Goldstein & Fox P.L.L.C.

(57) ABSTRACT

The present invention relates to a stimulation device (1) configured for interacting with an external body portion of a user, in particular the user's back. The interaction consists of exerting a mechanic action upon the user's body, 5 such as massage stimulation and/or skin scrubbing stimulation. For this purpose, the stimulation device (1) comprises a frame (50) provided with at least one upright element (2) extending along a longitudinal direction (L) preferably corresponding, in use, to a body height of the user, and stimulation means (4), slidably coupled with the upright element (2) according to the 10 longitudinal direction (L). Further, the stimulation device (1) is apt to be installed, in use, in a wall unit (100) for a shower cabin assembly (1000).

34 Claims, 8 Drawing Sheets

(51) Int. Cl.

| | |
|---|---|
| ***A47K 7/02*** | (2006.01) |
| ***A61H 33/00*** | (2006.01) |
| *A61H 1/02* | (2006.01) |
| *A61H 15/00* | (2006.01) |
| *A61H 35/00* | (2006.01) |

(52) U.S. Cl.
CPC ..... *A61H 33/6005* (2013.01); *A61H 1/0292* (2013.01); *A61H 15/0078* (2013.01); *A61H 35/006* (2013.01); *A61H 2015/0014* (2013.01); *A61H 2033/0079* (2013.01); *A61H 2201/164* (2013.01); *A61H 2203/0406* (2013.01)

(58) Field of Classification Search
CPC ... A61H 33/60; A61H 33/6005; A61H 1/0292
USPC ..... 4/606
See application file for complete search history.

(56) References Cited

U.S. PATENT DOCUMENTS

| | | | | |
|---|---|---|---|---|
| 5,335,378 | A | 8/1994 | Chiang | |
| 5,561,869 | A | 10/1996 | Sarel | |
| 8,621,679 | B1 * | 1/2014 | Donikian | 4/606 |
| 9,521,932 | B2 * | 12/2016 | Donatelli | A47K 7/024 |
| 2003/0167565 | A1 * | 9/2003 | Yoshida | A47K 7/04 4/606 |
| 2009/0241257 | A1 | 10/2009 | Malta | |
| 2016/0262578 | A1 | 9/2016 | Donatelli | |

* cited by examiner

SHOWER CABIN ASSEMBLY

FIELD OF THE INVENTION

The present invention relates to a stimulation device configured to provide an interaction with an external body portion of a user, in particular the user's back.

BACKGROUND OF THE INVENTION

Benefits resulting from a shower are well known.

A shower in the morning, after a long night of sleep, facilitates the awakening, distends muscles and gives you the right energy to face the day.

A shower at the end of the day washes away sweat and pollution from the skin, as well as sand and sea salt after a day at the beach, especially in summer.

Having a shower is a practice particularly useful and relaxing, in particular after practicing sports, when it further calms muscles tensions, reduces the body temperature and favours physiological parameters returning to standard values.

Often, during a shower other activities are carried out in order to restore wellness of skin and muscles.

One of the most common practices is having a skin scrubbing. Doubtless, shower is the perfect time to have skin exfoliation, which consists mostly in removing a superficial layer of dead cells or other materials (such as dust, smog or other inorganic particles). The scrubbing consist in massaging the skin with substances containing particles with abrasive characteristics (mechanical or chemical), which favour the skin exfoliation process.

Another typical scrubbing technique provides using the classic horsehair or loofah glove.

Anyhow, this practice requires the user to buy a specific scrubbing product or substance, this having often a high cost (due to the specific product/substance used), and further requires the user to physically operate the spreading of the substance on the body and the rubbing of the skin. These actions can annoy the user, thus resulting in a lower relaxing action of the shower.

Furthermore, the user is not always able to easily reach all points of the body, thus resulting in a not complete skin scrubbing action.

Another practice which is particularly effective and relaxing if practiced during shower is the massage. The benefit effects resulting from a massage are magnified is the massage is execute during a shower, thanks to water action. Disadvantageously, the user cannot practice a massage on himself alone, but the presence of another person, other than the user, is required, if only because the user alone cannot reach all points of his body.

The presence of another user inside the shower cabin can be not well regarded by the user, at least for privacy reasons, as well as shower cabins of reduced dimensions cannot allow at all simultaneously presence of two persons inside.

Therefore, the prior art discussed above does not provide an optimised technical system allowing the full exploitation of the synergistic effect of combining a shower with a scrubbing and/or massaging action.

SUMMARY OF THE INVENTION

The technical problem underlying the present invention is therefore that of overcoming the drawbacks mentioned above with reference to the state of the art. In particular, the invention is aimed at providing a stimulation device configured for interacting with an external body portion of a user, which device is further configured to be installed, in use, in a wall unit for a shower cabin, in order to allow stimulation of user's body when the user is having a shower.

Such problem is solved by a stimulation device according to claim 1.

There is also an independent claim 31 referred to a wall unit comprising such device and an independent claim 35 referred to a shower cabin comprising such device.

Preferred features of the invention are recited in the dependent claims.

The stimulation device according to the present invention is aimed at providing an improved shower service, and above all to add more features to the "shower time", increasing the physical and physiological beneficial effects due to a traditional shower. The stimulation device of the invention is configured for installation within a wall unit of a shower cabin, as to combine benefits resulting from the shower with benefits provided by the interaction of the user's body with the stimulation device.

For this purpose, the claimed stimulation device comprises movable stimulation means, that is actuated at least according to a sliding motion. Preferably, the sliding direction corresponds, in use, to a body height of the user. Thanks to this particular configuration, the user can enjoy back stimulation, without requiring the presence of another person.

According to a first aspect of the invention, the stimulation device comprises stimulation means at least partially provided with rough pattern surface configured for exerting a scrubbing action upon the user's body.

According to another aspect of the invention, the stimulation device comprises stimulation means at least partially provided with an external surface configured for exerting a massaging action upon the user's body.

Thanks to the above mentioned embodiments, the stimulation device allows providing skin scrubbing or massage actions, also simultaneously (according to the configuration of stimulation means). However, it is possible to switch from a kind of stimulation to another by simply substituting the stimulation means.

According to a preferred embodiment of the invention, massaging and scrubbing actions are assisted by the ejection of substances as oils or soaps by the stimulation means itself.

In particular, skin scrubbing and body massaging are practiced by a roller comprised in such stimulation means. The roller is preferably shaped as a rotating arm, which is configured to slide and simultaneously rotate around and axis of its main development.

Main advantages achieved by means of preferred embodiments of the claimed invention consist in providing, during a shower, scrubbing and massaging actions that result in:

- oxygenation of skin tissue, thus helping to maintain a toned skin;
- elimination of dead cells, to encourage the renewal of the skin;
- preventing growth of annoying ingrown hairs; and
- muscles relaxation.

Furthermore, a more preferred embodiment of a stimulation device according to the invention comprises supporting means to which the user can engage with his hands. Such supporting means are preferably in the form of a sliding bar, which can be moved under a pushing force exerted by the user, or more preferably by a motorized moving system. When the user translates bar upwards, or the automated bar slides upwards slightly lifting the user, back muscles are stretched.

At the same time, if the user is turned with his back to the sliding and rotating stimulation means, such means stimulates the lumbar spine, performing rolling movements from the shoulders to the pelvis, helping to stretch muscles and extend spine, and performing a lower back massage.

This kind of treatment helps to relieve tensions and improve the elasticity of paravertebral and lumbar muscles. Especially in presence of soreness, with inflammation and pain, this activities and massages had during a shower, preferably with hot water, allow a discharge and decompression action of the user's spine.

According to another aspect of the invention, further stimulation means can be provided by means of a stimulating walking surface, in use positioned at a floor surface of the stimulation device or of the shower cabin assembly.

Preferably, the stimulating walking surface is provided with ejecting nozzles and/or protruding elements shaped to stimulate user's soles of feet when he/she is having a shower.

In order to allow the user to switch between a stimulating walking surface and a traditional walking surface, preferably the stimulation device according to the invention comprises a floor plan providing a traditional walking surface which covers a stimulating walking surface. The floor plan can be selectively removed or retracted, leaving exposed the stimulating walking surface.

Furthermore, preferred embodiments of a shower cabin according to the present invention comprise other accessory items, such that: colour therapy system, Scottish shower system or multimedia connection with external electronic devices.

BRIEF DESCRIPTION OF THE DRAWINGS

Reference will be made to the figures of the annexed drawings, wherein.

each of FIGS. 7 to 9 shows a preferred embodiment of a feet stimulating unit according to the present invention, respectively in a rest configuration, in an intermediate configuration and in an operative configuration.

The above-mentioned Figures are to be meant exclusively by way of example and not for limitative purposes.

DETAILED DESCRIPTION OF PREFERRED EMBODIMENTS OF THE INVENTION

Figure 1:
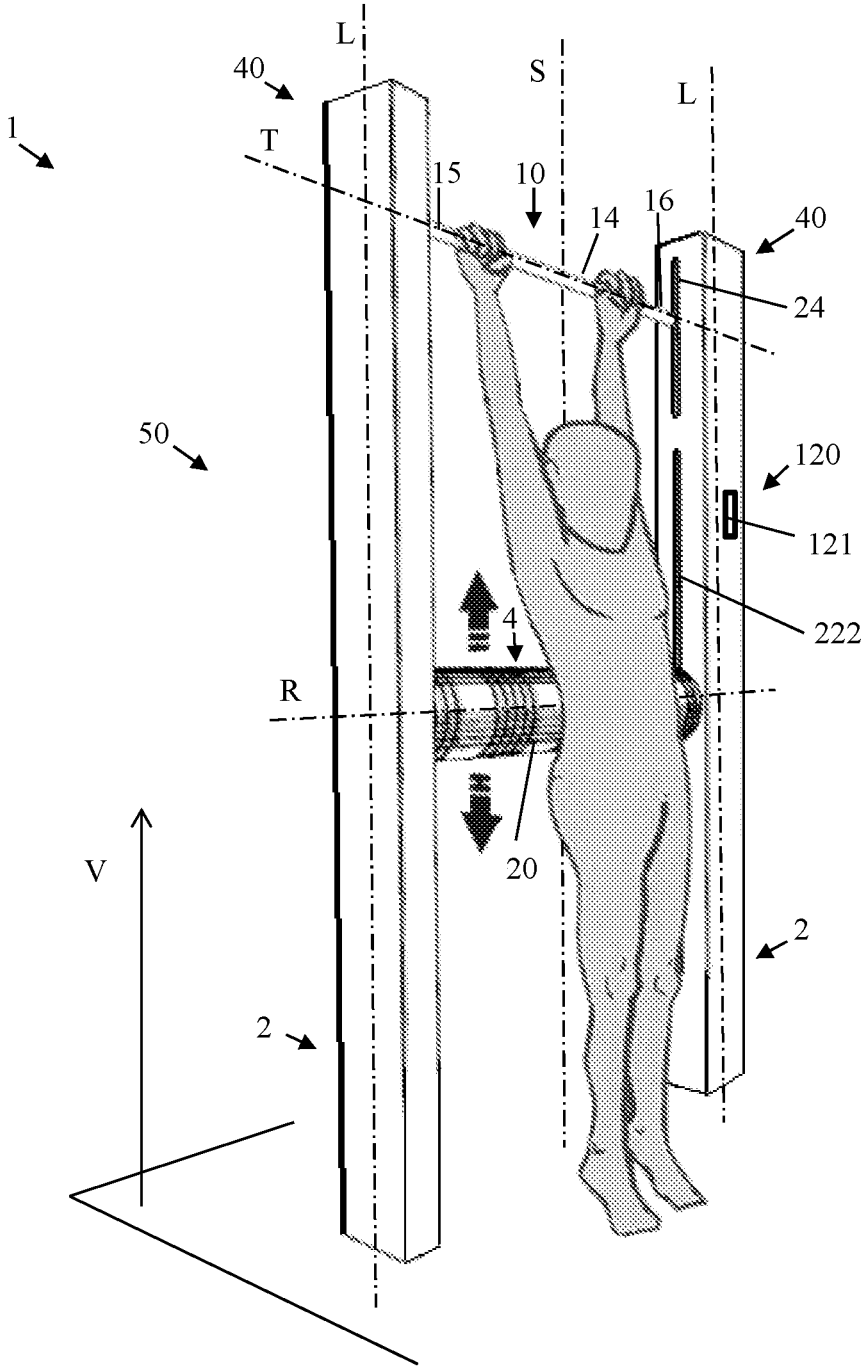
FIG. 1 shows a perspective front view of a preferred embodiment of a stimulation device according to the present invention.

With reference to FIG. 1, a stimulating device according to a preferred embodiment of the present invention is globally denoted by 1.

The stimulation device 1 is configured for interacting with an external body portion of a user, in particular the user's back. The interaction consists of a mechanic action upon the user's body, such as massage stimulation and/or skin scrubbing stimulation, according to user's preferences.

In order to allow stimulation of user's body when the user is having a shower, as to combine the benefits of the shower and of the interaction between the user's body and the claimed device 1, the stimulation device 1 is apt to be installed, in use, in a wall unit for a shower cabin. Preferably, the device 1 is installed according to a vertical direction V, such arrangement allowing the user to enjoy the body stimulation when he is having a shower in an upright position, as shown in FIG. 1.

The stimulation device 1 comprises a frame 50, which in turn comprises at least one upright element 2 extending along a longitudinal direction L, and stimulation means 4. The upright element 2 can present any kind of shape, for example can have a polygonal, preferably rectangular or squared, transverse section, as well as a circular or elliptical transverse section.

The direction L preferably corresponds, in use, to a body height of the user. According to the preferred embodiment shown in FIG. 1, the frame 50 comprises two uprights elements 2 and stimulation means 4 is preferably interposed therebetween. According to the preferred embodiment of the invention shown in FIG. 1, the frame 50 can present an axis of longitudinal symmetry S having the same direction of the longitudinal direction L, with respect thereto the two uprights elements 2 are specular. In particular, the two upright elements 2 are parallel to one another.

The stimulation device 1 further comprises stimulation means 4 configured to interact in a controlled manner with an external body portion of a user, in particular the user's back. The stimulation means 4 are slidably coupled or couplable at least to one upright element 2 according to the longitudinal direction L. The upright element 2, to which stimulation means 4 are coupled or couplable, comprises stimulation guide means 222, configured for allowing the sliding of stimulation means 4 along the longitudinal direction L.

Preferably, stimulation guide means 222 are provided at a central portion of upright element/s 2, such as to correspond, in use, to the user's back. Such stimulation guide means 222 can comprise a groove extending along longitudinal direction L, opportunely shaped for a sliding connection with stimulation means 4. Preferably, stimulation means 4 has a substantially oblong shape and more preferably extends, in use, according to a direction substantially transversal to longitudinal direction L.

Figure 3:
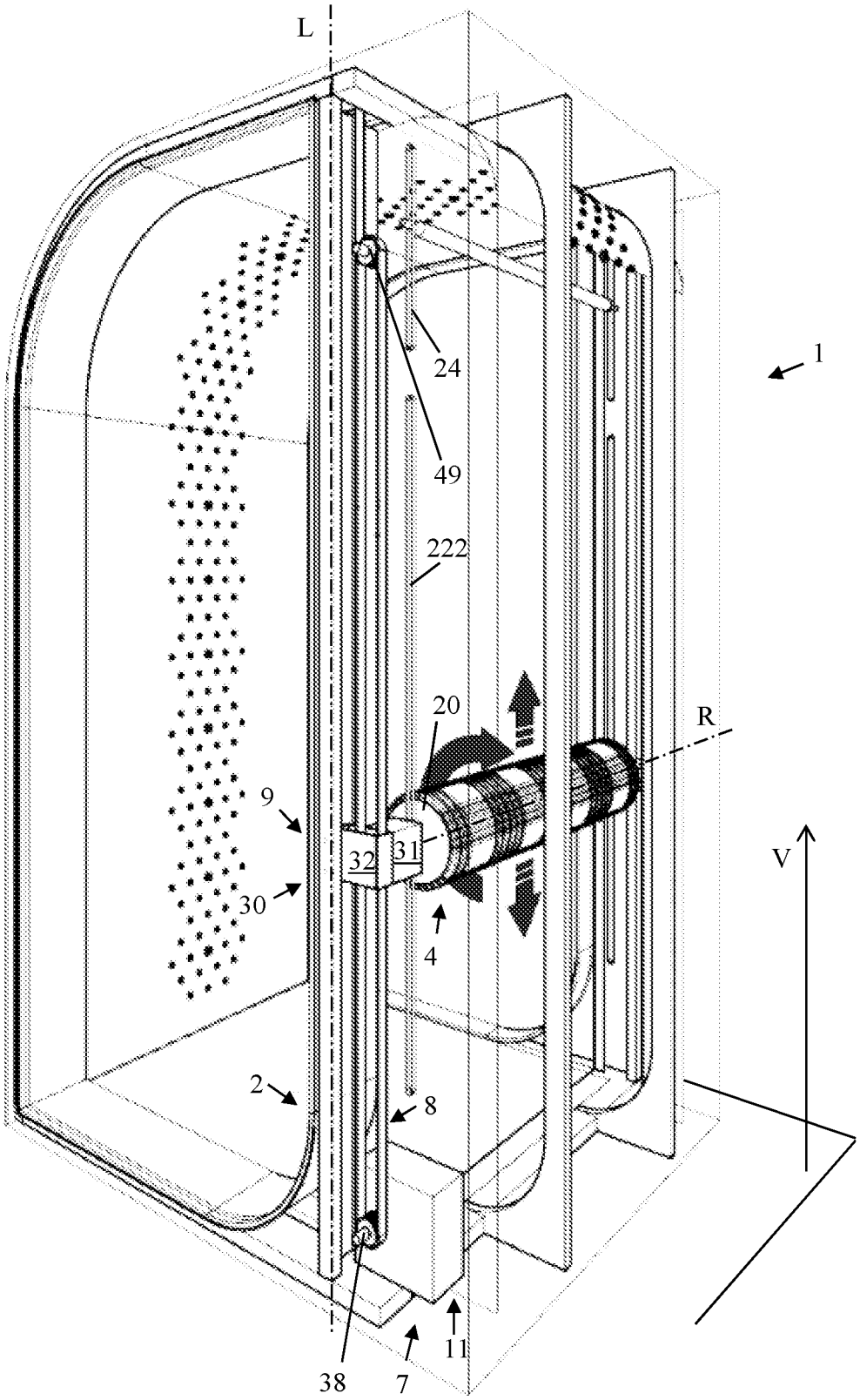
FIG. 3 shows a partially-transparent perspective back view of a preferred embodiment of a shower cabin assembly according to the present invention.
Figure 4:
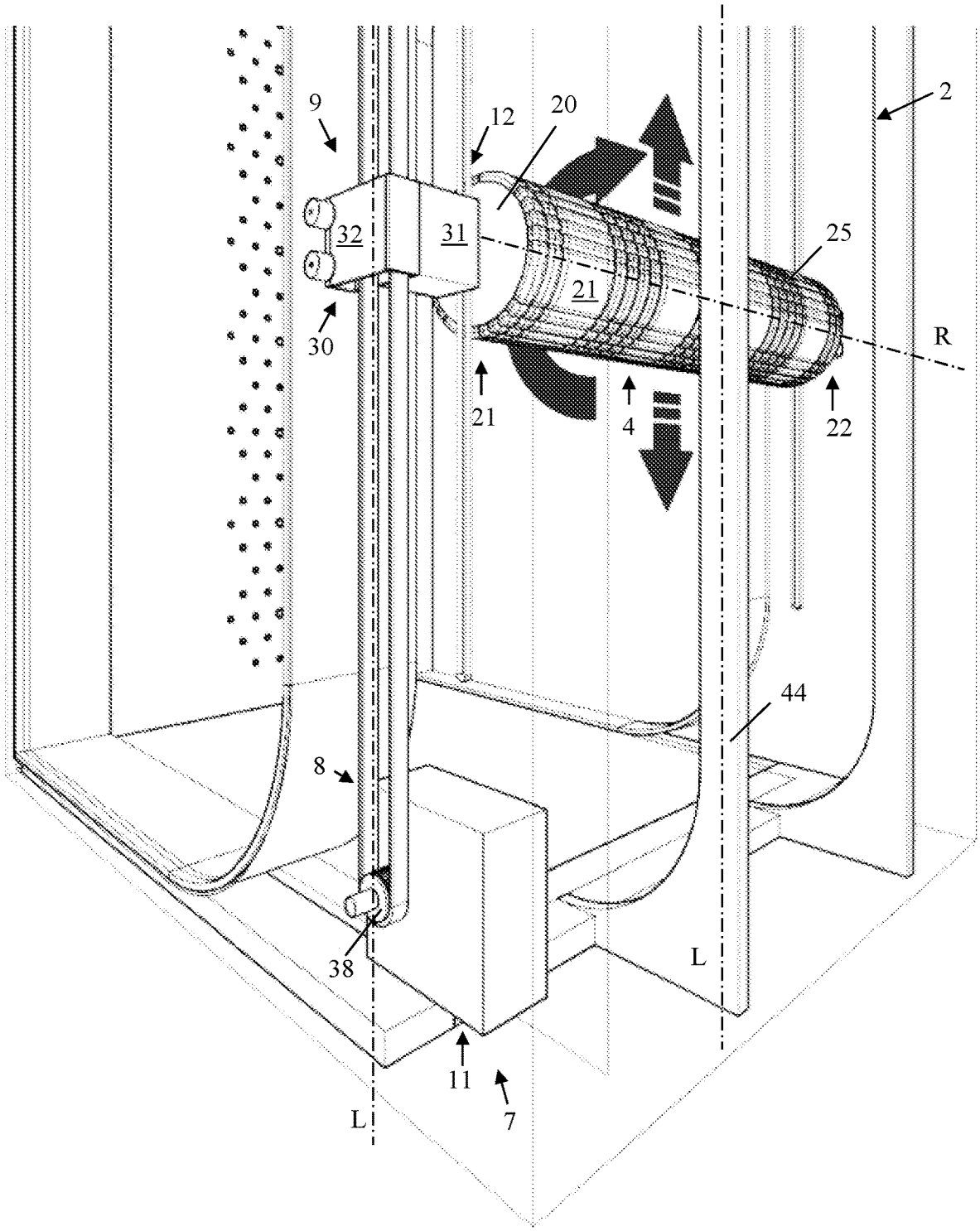
FIG. 4 shows a detail of FIG. 3.

Stimulation means 4 are connected or connectable to moving means 7, shown in FIGS. 3 and 4. Moving means 7 is apt to activate a sliding motion of stimulation means 4 along the longitudinal direction L, preferably according to both ways of the longitudinal direction L, that results in use in a translation according to vertical direction V. Such moving means 7 can be manually or automated actuated, as will be better explained in the following parts of the description.

Furthermore, in combination or in alternative to the above described sliding motion, such stimulation means 4 can be rotatable according to a rotation axis R, wherein preferably the overall configuration is such that rotation axis R is arranged orthogonal to longitudinal direction L.

According the preferred embodiment of the invention shown in FIG. 1, stimulation means 4 can comprise a roller 20 having a rotation axis R.

With reference to FIG. 4, stimulation means 4 has an external surface 21 configured to be in contact with user's skin, at least partially comprising protruding means 25 configured to stimulate an external body portion of the user, in particular the user's back. Protruding means 25 is in particular configured to make a massage stimulation or a skin scrubbing stimulation upon the user's body, depending upon the dimensions, in particular the length, of protruding means 25 itself, as well as from the speed of the sliding and/or rotational motion.

According to purpose of the present invention, stimulation means 4 is made of biocompatible material, and can be configured to eject substances apt to assist body stimulation and assure skin care, such as oils and soaps, or to be coated with a film or layer comprising such materials.

In particular, stimulation means 4 can comprise an external surface 21 at least partially providing a rough pattern configured for exerting a scrubbing action upon the user's body, or at least partially configured for exerting a massaging action upon the user's body. In alternative, or in combination to such embodiment, the external surface 21 can be at least partially coated by bands or strips of materials with a specific surface finish (rugosity). Such coating bands or strip are configured to be removably fixed on stimulation means 4, and are easy to be substituted with other ones providing different functionalities, according to the user's requirements.

Preferably, stimulation means 4 has an external surface 21 being at least partially porous and/or having dispensing holes or nozzles for delivering a substance upon the user's body, for example substances apt to assist body stimulation and assure skin care as above said.

With reference to FIGS. 3 and 4, the stimulation device 1 comprises moving means 7 for providing stimulation means 4 sliding along the longitudinal direction L, as already said. Such moving means 7 comprises a first motor 11 and means for transmitting motion 8 between such motor 11 and stimulation means 4. Preferably, the device 1 can comprise further guide means in order to stabilize the sliding motion of stimulation means 4, such as a bar element 44 upon which stimulation means 4 can slide, such bar element 44 extending along longitudinal direction L.

According to a preferred embodiment of the invention, the overall configuration of the device 1 is such that the motor 11 is preferably positioned at a lower portion of the upright element 2 to which stimulation means 4 are coupled or couplable. Such configuration helps to reduce the effects and the perception of vibrations from the motor 11 and makes the device 1 more stable.

Means for transmitting motion 8, preferably comprising mechanical transmission means apt to resist to traction stresses, is preferably configured to transform a rotation motion of the motor 11 into a translation motion of stimulation means 4. Said transmitting means 7 can comprise chains or belts, in particular continuous and/or endless, preferably arranged at the upright element 2 along the longitudinal direction L, as shown in FIGS. 3, 4.

In particular, the device 1 can comprise connection means 30 configured to connect a first and/or second longitudinal end 21, 22 of stimulation means 4 to at least one upright element 2.

The connection means 30 comprises a first portion 31 apt to be connected to the first or second longitudinal end 21, 22 of stimulation means 4 and a second portion 32 apt to be connected to means for transmitting motion 8. Said second portion 32 can also slide within stimulation guide means 222 opportunely configured to allow so. In particular, the first portion 31 of connection means 30 can comprise a seat configured for house the first or second longitudinal end 21, 22 of stimulation means 4, and to allow a rotation of said stimulation means 4 with respect to the seat itself.

Means for transmitting motion 8 are engaged or apt to be engaged with said second portion 32 of connection means 30 and with at least a driving roller 38 actuated by the motor 11. Furthermore, means for transmitting motion 8 are engaged or apt to be engaged also with a return pulley 49, positioned at an upper portion of the upright element 2, preferably at an upper terminal end of stimulation guide means 222, when the motor 11 is positioned at a lower portion of the upright element 2.

As already described, stimulation means 4 can rotate around a rotation axis R. For this purpose, the device 1 can comprise rotation actuation means 9 comprising a second motor 12 apt to put stimulation means 4 into rotation. Said motor 12 is preferably positioned at or within the first portion 31 of connection means 30. Furthermore, the device 1 can comprise control means 120 configured to actuate actuation means 9 and/or moving means 7.

Figure 6:
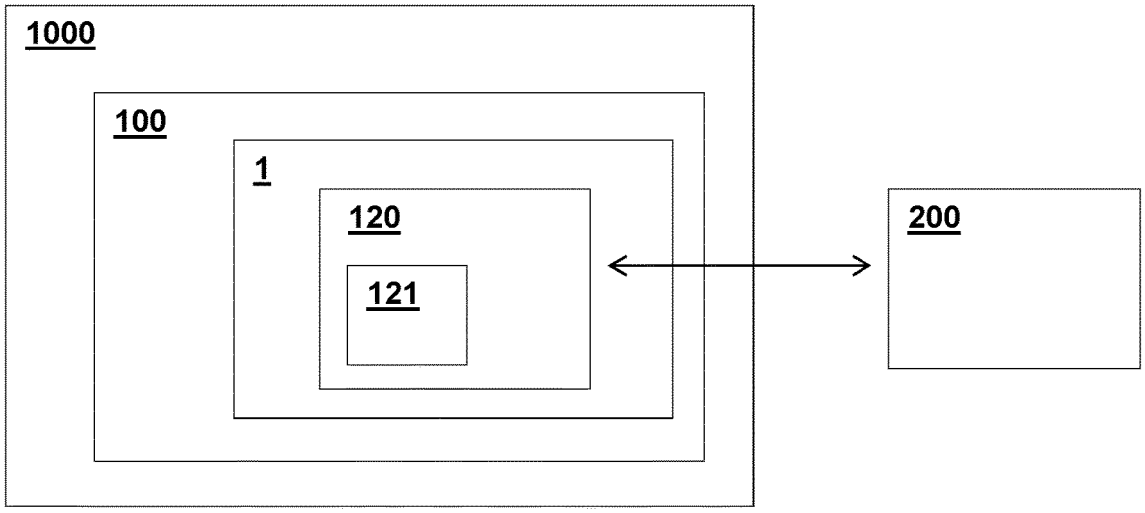
FIG. 6 shows a block diagram representing a preferred embodiment of a shower cabin assembly according to the present invention.

Such control means 120 preferably comprises a local interface 121, for example comprising a touch screen positioned at an upper element 2 in a position such that can be operated by a user during the body stimulation, and/or is connected to a remote control system 200, as shown in the exemplary block diagram of FIG. 6. Control means 120 can be configured to communicate not only with said actuation and/or moving means 7, 9, but also with other elements, systems and devices provided by the stimulation device, the wall unit and/or the shower cabin to which the device can be associated to.

According to a preferred embodiment of the invention, local interface 121 comprises a display where the user can select and customize operation programs of the stimulation device and/or the shower cabin, such programs for example being complex programs combining chromo-therapy, music therapy, aroma-therapy and other kinds of therapy improvable by means of the invention with the stimulation therapy.

Figure 10A:
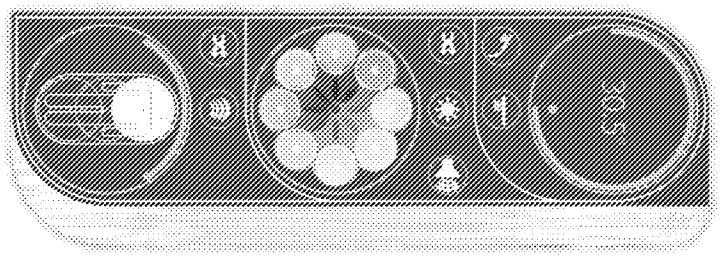
FIGS. 10*a* and 10*b* show preferred embodiments of remote interface means according to the present invention.
Figure 10B:
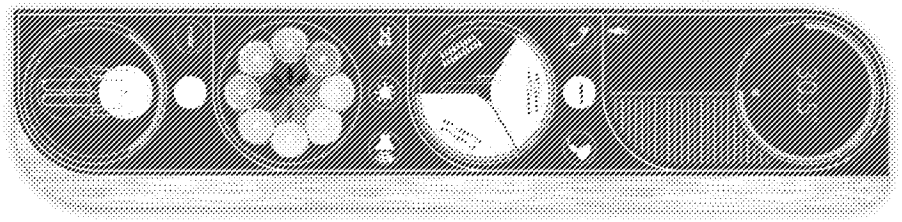

According to other embodiments of the invention, control means further (or in alternative to the local interface) comprises remote interface means, shown by way of example in FIGS. 10*a* and 10*b*. In particular, remote interface means comprises a display which is configured to allow a "one-touch" selection mode of a complex program, preferably based on pushing a certain button and/or selecting a certain colour from an allowable selection of colours.

For example, by pushing a pink button, a relax complex program is selected, providing a stimulation/massage action by activating stimulation means, activating lighting devices configured for emitting a pink coloured light and adjusting the water temperature according to a predetermined value.

In particular, by such control means 120, the user can adjust the speeds of translation and/or rotation of stimulation means 4, as well as fix a limit switch for sliding stimulation means 4 along the stimulation guide means 222, in order to adapt the stimulating action to anatomy and requirements of the user. Furthermore, other shower conditions, such as water temperature and pressure, can be adjusted by such control means 120. The actuation means 9 and moving means 7 can be actuated independently of each other, such that stimulation means 4 can only slide along said longitudinal direction L, only rotate around said rotation axis R or simultaneously slide and rotate for stimulating an external body portion of the user.

According to the preferred embodiment shown in FIG. 1, device 1 can further comprise supporting means 10 configured to allow the user hold on to it, in particular to clutch it with the hands, in order to allow the user keep a stable position during the body stimulation. Such supporting means 10 preferably extends according to a direction substantially transversal with respect to the longitudinal direction L.

In particular, supporting means 10 is positioned at an upper portion 40 of the upright element/s 2, and when the frame 50 comprises two upright elements 2 the supporting means 10 is interposed there between. In order to adjust the position of supporting means 10 with respect to said at least one upright element 2 according to the user anatomy, device 1 preferably comprises support guide means 24, and can comprise also means for fixing the position of the supporting means 10.

Such support guide means 24 can be comprised in the upright element/s 2 or are connected/connectable thereto, and are preferably configured for allowing the sliding of supporting means 10 along longitudinal direction L, for example under the push exerted by the user or more preferably thanks to an automated moving system of such supporting means 10.

Supporting means 10 can comprise at least an oblong support element 14 connected or apt to be connected at its first or second terminal end 15, 16 to at least one upright element 2, and when said frame 50 comprises two upright elements 2, said support element 14 can be connected or apt to be connected thereto at its first and second terminal end 15, 16. In particular, the support element 14 is tubular shaped and presents a main developments axis T, for example orthogonal to longitudinal direction L.

According to the preferred embodiment shown in FIG. 1, the overall configuration of device 1 is such that rotation axis R is arranged orthogonal to longitudinal direction L, preferably parallel to and aligned with main developments axis T along longitudinal direction L, with main developments axis T being at height—considered along the vertical axis V and the longitudinal direction L, starting measuring from the floor—greater than the maximum height reachable by stimulation means 4 during its sliding motion.

Such configuration further allows the user to keep its back distended during stimulation when holding on supporting means 10, in order to realize a most effective massage and/or skin scrubbing.

Figure 2:
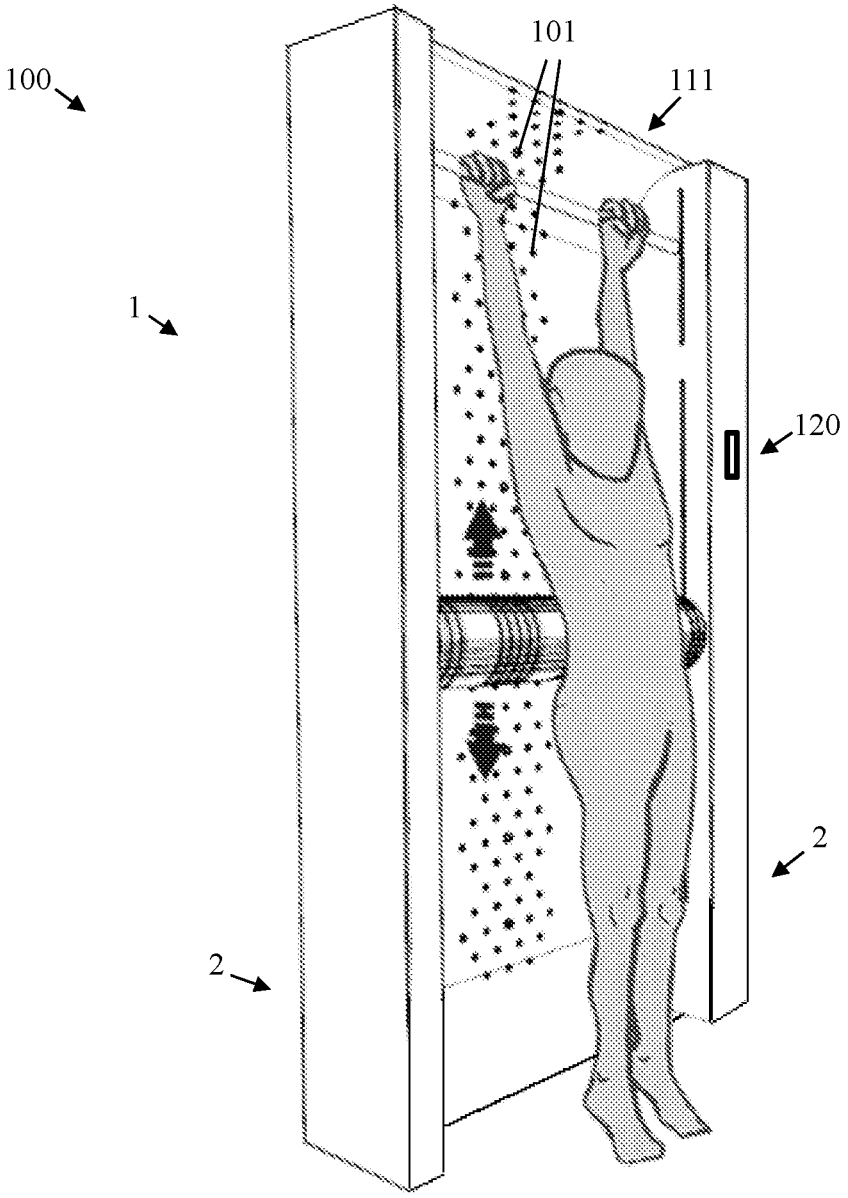
FIG. 2 shows a perspective front view of a preferred embodiment of a wall unit according to the present invention.

With reference to FIG. 2, the present invention refers also to a wall unit 100 for a shower cabin, comprising a body stimulation device 1 according to what previously described.

The wall unit 100 preferably comprises a panel 111 configured for installation of the stimulation device 1. In particular, the panel 111 presents a plurality of holes 101 configured to house nozzles (or other equivalent means) for selective ejection of water. Control means 120 can be further configured to allow the user actuate and adjust such water ejection, as regarding speed and temperature of water flow emitted.

According to the preferred embodiment of wall unit 100 shown in FIG. 2, the panel 111 is arranged as a back wall portion of at least one upright element 2. In particular, said panel 111 comprises a back wall portion and a ceiling portion arranged substantially orthogonal to the back wall portion, wherein the ceiling portion and/or the back wall portion has a plurality of holes 101 configured to house nozzles (or other equivalent means) for selective ejection of water, according to what already disclosed.

Figure 5:
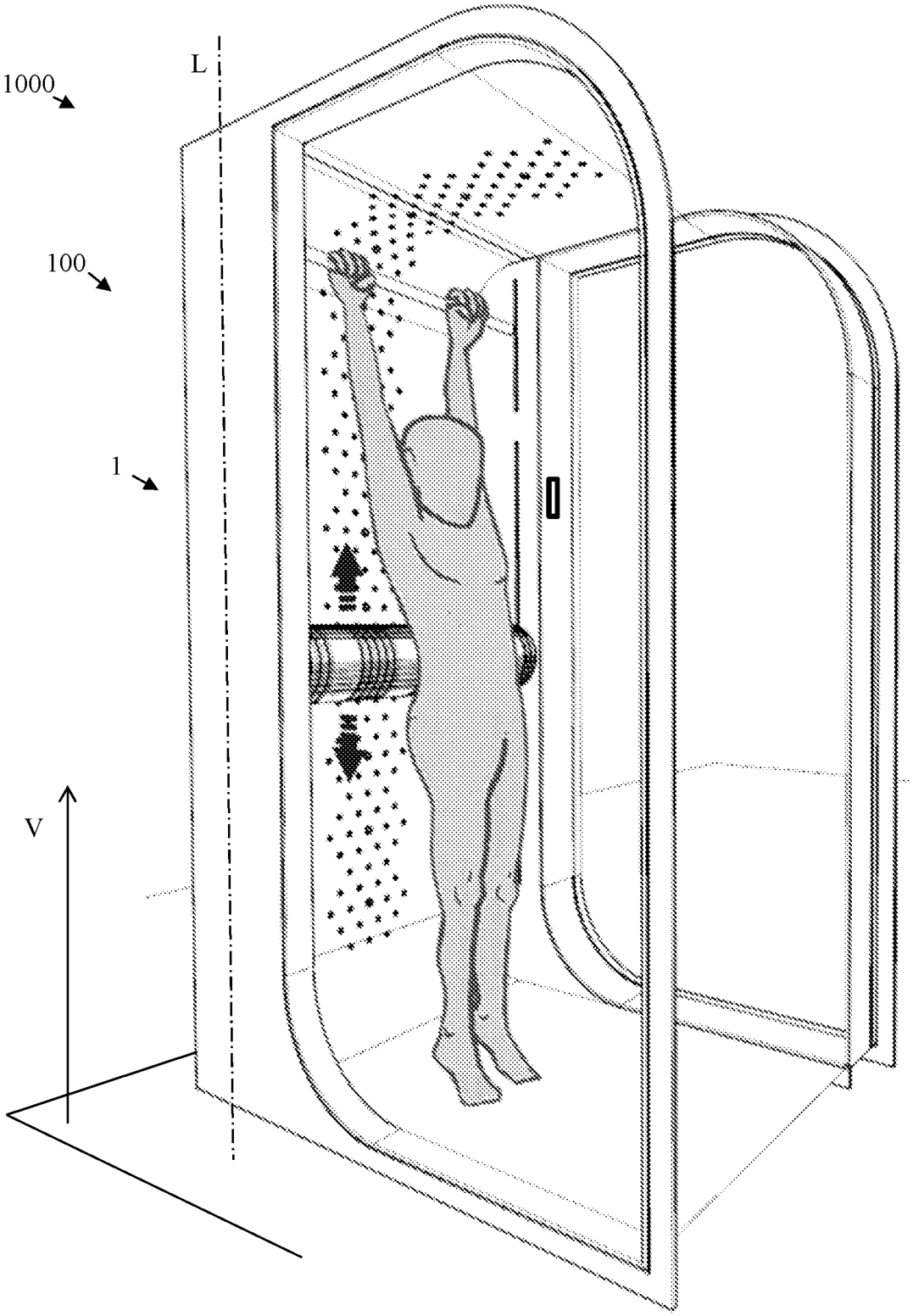
FIG. 5 shows a partially-transparent perspective front view of a preferred embodiment of a shower cabin assembly according to the present invention.

Further scope of the present invention is to provide a shower cabin assembly 1000, as shown by way of example in FIG. 5. The shower cabin assembly 1000 comprises a wall unit 100, such wall unit 100 in turn comprising a stimulation device 1. In particular, the overall configuration of the shower cabin assembly 1000 is such that the longitudinal direction L coincides with a vertical direction V orthogonal to the floor or to the walking surface of the shower cabin.

Furthermore, according to preferred embodiments of the present invention, the stimulating device 1 can be associated to a shower cabin comprising other accessory items. For example, colour therapy systems, aroma therapy systems, music therapy systems, Scottish shower systems or similar therapy systems can be susceptible of combination with the present invention.

According to a further aspect, the present invention provides a stimulation unit apt to allow stimulation of user's feet when the user is having a shower.

It is to be intended that the feet stimulation unit object of the below description is configured to be used in a standalone configuration, or comprised in a stimulation device according to the invention, or associated with a traditional shower cabin, or in combination with a shower cabin assembly according to what already disclosed.

The feet stimulation unit according to the present invention is preferably configured to be installed at a lower portion of a shower cabin, substituting at least a portion of the shower cabin's floor surface. The configuration is such that the unit is apt to provide a traditional floor surface or a stimulation floor surface according to user's preferences.

For this purpose, speaking in general terms, a feet stimulation unit according to the present invention substantially comprises an upper face which provides a traditional walking surface and feet stimulation means which can be selectively activated. With the activation of the stimulation means, a stimulation walking surface is provided.

Figure 7:
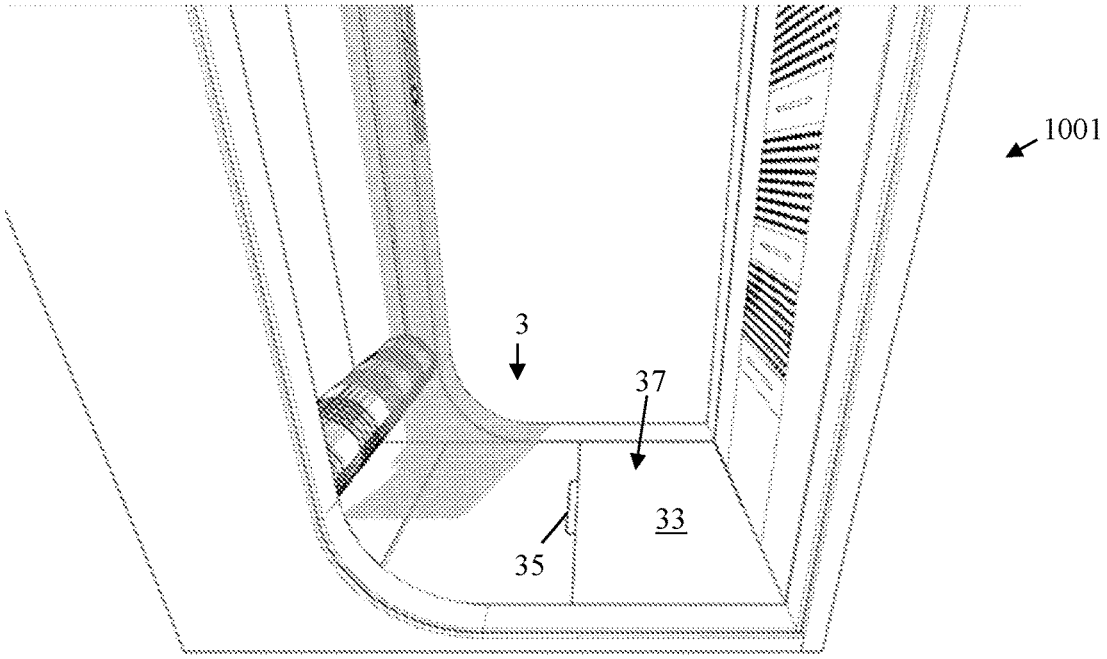
Figure 8:
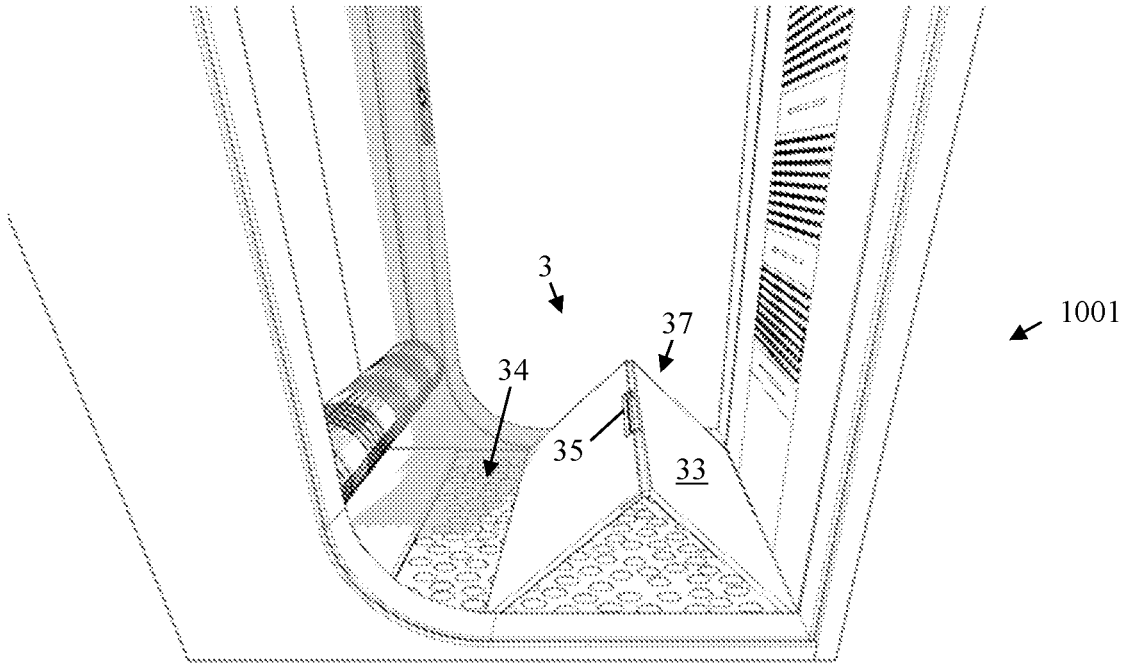
Figure 9:
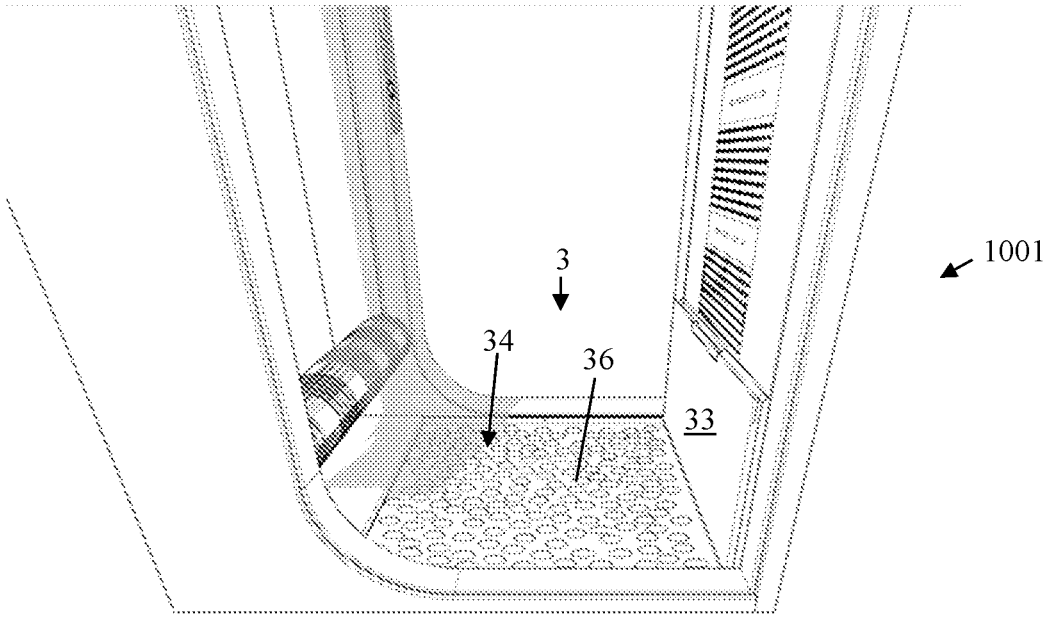

With reference to FIGS. 7 to 9, a preferred embodiment of a feet stimulation unit 3 is shown, in association with a preferred embodiment of a shower cabin assembly 1001 according to the present invention.

According to such preferred embodiment, the feet stimulation unit 3 is substantially box shaped, in particular it is shaped as a container with an internal base 34, a lateral surface and an upper external face 37.

The internal base 34 and the lateral surface are arranged in such a way as to cooperate to the realization of a containment space for liquid fluids, to allow the user having a footbath.

The feet stimulation unit 3 can have a plan according to any kind of geometry, for example a round, square or rectangular plan, with geometry and dimensions varying according to geometry and dimension of the shower cabin to which it is to be associated (if any). In the attached Figures, the unit 3 is overall shaped like a parallelepiped.

At the base 34 stimulation means is provided, which can be selectively put in an operative configuration by remote or local control means, according to what previously described.

In the preferred embodiment shown, stimulation means comprises one or more, preferably a plurality of, elements 36 protruding from the base 34. In particular, at least an upper portion thereof can protrude from the base 34, realizing a stimulating walking surface.

The stimulating protruding elements 36 are preferably cylindrical shaped, and can present a rounded upper protruding portion in order to realize a comfortable stimulation of user's soles, the upper portion being tapered or enlarged with respect to the remaining part of the element, according with user's preferences. To allow the user to easy switch from one kind of stimulating elements to another, the upper protruding portion of the stimulating elements is preferably removable and replaceable.

Such elements 36 can be fixed at the base 34, according to a predetermined height of protrusion, or can be inserted within openings of the base 34, each being shaped as to house at least one of such elements.

According to the latter embodiment, the extent of protrusion of elements 36 from the surface of the base 34 can be adjust by moving means connected to the protruding elements. In particular, such moving means is configured for: moving the elements 36 in translation through the openings of the base and/or putting elements in rotation according to a main axis thereof, that is a symmetry axis when the protruding elements are cylindrical shaped.

The coupling between the protruding elements and the base 34 is configured to ensure the containment of liquid fluids at the base 34.

According to a preferred embodiment of the invention, stimulation means further comprises nozzle for ejecting water or other kind of fluids, such as cleaning or detoxing liquid substances, preferably ionized solutions. Preferably, said nozzle can be provided at the upper protruding portion of stimulating elements 36. Otherwise, such nozzles can be provided at the surface of the base 34, or at the internal lateral surface of the unit 3.

The nozzles can be fluidic connected to one or more selectable fluid reservoirs, which contains the fluid to be ejected at a selectable pressure and temperature.

The base 34 can be further provided with discharge means, which can be selectively activated for conveying liquid fluids to a discharge line or to a tank for collection of exhaust fluids.

The moving means and the nozzles are preferably connected to control means configured for controlling their actuation, comprising a local and/or remote user interface, according to what already described with reference to the previously embodiments.

Furthermore, by the above said control means, it is possible to actuate such protrusion elements 36 in order to make them move outwards and towards the base 34, according to an alternative motion which speed rate can be regulated, as well as other parameters like the position of maximum extraction with respect to the base 34 and/or the rotation speed.

Furthermore, the user can select temperature, pressure and kind of fluid to be ejected by nozzles by said control means, together with other ejection parameters.

As above said, the feet stimulation unit 3 comprises an internal base 34, a lateral surface and an upper face 37. In particular, the upper face 37 comprises an external, traditional substantially flat walking surface 33.

The face 37 is fully or at least partially removable, or its encumbrance can be reduced, according to a manual or automated mode. By removing the face 37, the stimulating walking surface of base 34 is exposed to the user.

Preferably, the upper face 37 is rotary connected to an upper side of the lateral surface of unit 3 by means of an rotary hinge, in order to allow the user to open the unit 3 by rotating the face 37 around the hinge and bringing the face 37 in a configuration of little encumbrance, for example aligned with a side wall of the shower cabin assembly to which the unit 3 is associated, as shown in FIG. 9.

More preferably, in order to further reduce the overall encumbrance of unit 3 when it is in an operative configuration, the face 37 further comprises at least two adjacent portions connected by a rotary hinge, which can be folded one over the other, as shown in FIGS. 8 and 9.

To facilitate the manual opening of the face 37, it can be provided with a handle 35, preferably positioned at a central portion thereof, at an hinge between two adjacent portions.

According to another simpler embodiment of the feet stimulation unit, stimulating protrusion elements can be provided at an external surface of the upper face thereof, inserted in respective openings provided at the external surface.

The configuration can be that, when the stimulating elements are in a rest configuration, an upper face or surface of such stimulating elements is aligned with the external upper surface of the unit, thus resulting in a substantially traditional flat configuration of the floor.

When the stimulating elements are in an operative configuration, they protrude out of the external upper surface. According to this configuration, a mechanical stimulation surface for user's soles of feet is realized from the upper external surface of the unit, and there's no need to remove the external face.

In addition to this, at the upper surface one or more nozzles can be provided, which selectively eject water or chemically stimulating fluids, such as detoxifying or ionized solutions, in order to mechanically and/or chemically stimulate user's feet with the fluid jets.

The stimulating protruding elements, as well as the nozzles, can be actuated by control means, according to what already said with reference to the embodiments previously described.

The present invention has been described so far with reference to preferred embodiments, which are intended to be combined if compatible. It is intended that there may be other embodiments which refer to the same inventive concept and fall within the scope of the appended claims.

The invention claimed is:

1. A stimulation device configured for interacting with an external body portion of a user, in particular the user's back, which stimulation device is apt to be installed in a wall unit for a shower cabin assembly, said stimulation device comprising:

(a) a frame comprising at least one upright element extending along a longitudinal direction, said longitudinal direction preferably corresponding, in use, to a body height of the user;

(b) a stimulation unit, slidably coupled or couplable with said at least one upright element according to said longitudinal direction; and (c) a moving unit of said stimulation unit, apt to activate a sliding motion of said stimulation unit along said longitudinal direction, preferably according to both ways of said longitudinal direction said stimulation device comprising supporting elements configured to allow the user hold on to it, preferably said supporting elements extending according to a direction substantially transversal with respect to said longitudinal direction, wherein said supporting elements have an adjustable position with respect to said at least one upright element, preferably by means of support guide elements comprised in said at least one upright element, said support guide elements being configured for allowing the sliding of said supporting elements along said longitudinal direction.

2. The device according to claim 1, wherein said at least one upright element comprises stimulation guide unit configured for allowing the sliding of said stimulation unit along said longitudinal direction.

3. The device according to claim 1, wherein said frame comprises two upright elements parallel one another and wherein said stimulation unit is preferably interposed there between.

4. The device according to claim 1, wherein said stimulation unit is rotatable according to a rotation axis.

5. The device according to claim 1, wherein said stimulation unit extends, in use, according to a main direction substantially transversal to said longitudinal direction.

6. The device according to claim 1, wherein said stimulation unit has a substantially oblong shape.

7. The device according to claim 1, wherein said stimulation unit comprises a roller having a rotation axis.

8. The device according to claim 7, wherein the overall configuration is such that said rotation axis is arranged orthogonal to said longitudinal direction.

9. The device according to claim 1, wherein said stimulation unit has an external surface at least partially comprising protruding elements configured to stimulate an external body portion of the user, in particular the user's back, wherein said protruding elements are in particular configured to make a massage stimulation or a skin scrubbing stimulation depending upon the length of said protruding elements.

10. The device according to claim 1, wherein said stimulation unit has an external surface at least partially comprising a rough pattern configured for exerting a scrubbing action upon the user's body.

11. The device according to claim 1, wherein said stimulation unit has an external surface at least partially configured for exerting a massaging action upon the user's body.

12. The device according to claim 1, wherein said stimulation unit has an external surface being at least partially a porous surface and/or having dispensing holes or nozzles for delivering a substance upon the user's body.

13. The device according to claim 1, wherein said moving unit comprises:

(a) a first motor; and (b) devices for transmitting motion between said motor and said stimulation unit, wherein said devices for transmitting motion are configured to transform a rotation motion of said motor into a translation motion to said stimulation unit.

14. The device according to claim 13, comprising connection elements configured to connect a first and/or second longitudinal end of said stimulation unit to said at least one upright element, which connection elements comprise a first portion apt to be connected to said first or second longitudinal end of said stimulation unit and a second portion apt to be connected to said devices for transmitting motion.

15. The device according to claim 14, wherein said first portion comprises a seat configured for house said first or second longitudinal end and to allow a rotation of said stimulation unit with respect to said seat.

16. The device according to claim 14, wherein said devices for transmitting motion comprises chains or belts, in particular continuous and/or endless, engaging or apt to be engaged with said second portion and with at least a driving roller actuated by said first motor.

17. The device according to claim 1, comprising rotation actuation devices of said stimulation unit, which actuation devices comprise a second motor apt to put said stimulation unit into rotation.

18. The device according to claim 17, wherein said actuation devices and moving unit can be actuated independently of each other, such that said stimulation unit can only slide along said longitudinal direction, only rotate around said rotation axis or simultaneously slide and rotate for stimulating an external body portion of the user, in particular the user's back.

19. The device according to claim 1, comprising a control configured to actuate said moving unit and/or rotation actuation means of said stimulation unit.

20. The device according to claim 19, wherein said control unit comprises a local interface and/or is connected to a remote control system.

21. The device according to claim 1, wherein said supporting elements are positioned at an upper portion of said at least one upright element, and preferably when said frame comprises two upright elements said supporting elements is interposed there between.

22. The device according to claim 1, wherein said supporting elements comprise at least an oblong support element connected or apt to be connected at its first or second terminal end to said at least one upright element, and preferably when said frame comprises two upright elements said oblong support element is connected or apt to be connected thereto at its first and second terminal end.

23. The device according to claim 22, wherein said oblong support element is tubular shaped and presents a main developments axis.

24. The device according to claim 23, wherein said main developments axis is orthogonal to said longitudinal direction.

25. The device according to claim 22, wherein the overall configuration is such that said rotation axis is arranged orthogonal to said longitudinal direction, preferably parallel to and aligned with said main developments axis along said longitudinal direction.

26. The device according to claim 1, comprising a feet stimulation unit, which feet stimulation unit comprises:

(a) an upper external face providing a walking surface; and (b) feet stimulation devices which can be selectively activated.

27. The device according to claim 26, wherein said feet stimulation devices are provided at an internal base surface of said feet stimulation unit, which internal base surface is covered by said upper external face, the overall configuration being such that when said upper external face is removed or brought in a minimum encumbrance configuration, said internal base surface is exposed to the user.

28. The device according to claim 26, wherein feet stimulation devices comprise protruding elements, preferably movable according of a motion of distancing from/approaching to said base surface, and/or nozzles for ejecting liquid fluids.

29. A wall unit for a shower cabin, comprising a body stimulation device according to claim 1.

30. The wall unit according to claim 29, comprising a panel configured for installation of said body stimulation device, said panel presenting a plurality of holes configured to house nozzles for selective ejection of water.

31. The wall unit according to claim 29, wherein said panel is arranged as a back wall portion of said at least one upright element.

32. The wall unit according to claim 29, wherein said panel comprises a back wall portion and a ceiling portion arranged substantially orthogonal to said back wall portion, wherein said ceiling portion and/or said back wall portion has a plurality of holes configured to house nozzles for selective ejection of water.

33. A shower cabin assembly comprising a wall unit according to claim 29.

34. The shower cabin assembly according to claim 33, wherein the overall configuration is such that said longitudinal direction coincides with a vertical direction.

* * * * *